US005662312A

United States Patent [19]

Leggett et al.

[11] Patent Number: 5,662,312

[45] Date of Patent: Sep. 2, 1997

[54] PRESSURIZED SHEAVE MECHANISM FOR HIGH PRESSURE WIRELINE SERVICE

[75] Inventors: Henry H. Leggett, Hallsville; Russell C. Gilleylen, Longview, both of Tex.

[73] Assignee: Schlumberger Technology Corporation, Houston, Tex.

[21] Appl. No.: 686,177

[22] Filed: Jul. 22, 1996

Related U.S. Application Data

[63] Continuation of Ser. No. 304,876, Sep. 13, 1994, abandoned.

[51] Int. Cl.[6] ..... E21B 19/08

[52] U.S. Cl. ..... 254/390; 254/416; 384/475; 384/479

[58] Field of Search ..... 254/390, 416, 254/405, 389; 384/478, 475, 479; 166/75.1, 77, 81, 84

[56] References Cited

U.S. PATENT DOCUMENTS

| | | | |
|---|---|---|---|
| 2,630,180 | 3/1953 | Summers | 166/77 |
| 2,677,427 | 5/1954 | McKinney et al. | 166/77 |
| 2,720,266 | 10/1955 | Broussard et al. | 166/77 |
| 2,810,439 | 10/1957 | McCullough et al. | 166/77 |
| 2,943,682 | 7/1960 | Ingram, Jr. et al. | 166/77 |
| 3,363,880 | 1/1968 | Blagg | 166/75.1 |
| 4,542,787 | 9/1985 | Parker | 166/77 |
| 5,188,173 | 2/1993 | Richardson et al. | 166/77 |
| 5,392,861 | 2/1995 | Champagne | 166/77 |

*Primary Examiner*—Katherine Matecki

*Attorney, Agent, or Firm*—John H. Bouchard; John J. Ryberg

[57] ABSTRACT

A pressure containing wireline sheave mechanism having a sheave body defining an opening within which is received a sheave housing which cooperates with the sheave body to define a circular internal sheave chamber which is exposed to operating pressure such as well pressure during well servicing activities. A split sheave having an external wireline groove is located within the internal chamber and is rotatably supported at its inner periphery by bearings. During operation of the wireline sheave mechanism lubricant is supplied to the inner periphery of the internal sheave chamber at a location adjacent the bearing and at a lubricant pressure exceeding well pressure to prevent well pressure induced migration of contaminants from the wireline groove of the sheave to its bearings. Seals on each side of the internal sheave chamber establish sealing between the sheave body and sheave housing and cause well pressure induced force acting on the sheave housing to be substantially confined to hoop stress so that the sheave mechanism is protected against significant pressure induced internal side loading. This permits the sheave mechanism to be of relatively small dimension and of relatively lightweight construction without and sacrifice from the standpoint of pressure containing capability.

34 Claims, 4 Drawing Sheets

PRESSURIZED SHEAVE MECHANISM FOR HIGH PRESSURE WIRELINE SERVICE

This is a Continuation of application Ser. No. 08/304,876 filed Sep. 13, 1994, now abandoned.

FIELD OF THE INVENTION

This invention relates generally to wireline apparatus for use in conducting downhole well operations including well completion activities, well servicing activities and the installation and removal of various downhole well equipment. More particularly, the present invention concerns a sheave mechanism through which wireline passes as the wireline is being run into or extracted from a well and which sheave mechanism is designed to contain high well pressure in the range of 10,000 psi or greater and to provide for continuous grease injected sealing of the wireline while maintaining the wireline sheave and sheave housing in a substantially pressure balanced condition.

BACKGROUND OF THE INVENTION

When downhole activities are required in wells being drilled and completed it is frequently necessary at times during drilling operations to conduct well bore logging activities during which a logging tool is run into the well in order to evaluate the progress of the well bore and to identify various characteristics of the earth formation being traversed by the well bore. These operations are typically carried out by running logging tools into the well by means of wireline cables. Various other well servicing activities are carried by means of tools that are run into well bores or well casing by means of wireline apparatus. Especially when wells are being drilled and completed high pressure conditions are often encountered such as when production formations are intersected by the well bore.

When wireline operations are being conducted especially under conditions of high well pressure, wireline risers of significant height are often employed in order to provide the wireline apparatus with sufficient pressure containing capability to insure against the possibility of a well blowout through the wireline apparatus. These wireline risers incorporate grease wipers and wireline packers in addition to a wireline blowout preventer to thus render the wireline apparatus safe from the standpoint of containing well pressure. Typically an open sheave is mounted above the wireline riser and the wireline being run into or exiting the well extends about this upper sheave and thence downwardly to a lower sheave near ground level in route to a wireline winch which is typically mounted on a wireline service vehicle.

Of late, rather than providing extremely tall wireline risers especially under conditions where the height of the wireline riser is restricted, it is deemed desirable to provide a pressure containing sheave which is located at the upper end of a wireline riser of limited height and to provide a grease seal conduit extending downwardly from the pressure containing sheave head to thus achieve wireline containing apparatus of sufficient length for efficient pressure containing capability. An example of a pressure containing sheave disposed in pressure connection with a wireline riser and a grease seal conduit is presented by U.S. Pat. No. 5,188,173 of Richardson, et al. This type of pressure containing sheave has deficiencies in that it is restricted from the standpoint of pressure containing capability. The housing is subject to considerable pressure induced side loading, which, especially under high pressure conditions can significantly distort the body structure to the extent that the sheave can become inoperative. It is desirable therefore to provide a pressure containing sheave mechanism for wireline well servicing apparatus and for other activities.

As the wireline emerges from a well such as when a well tool is being raised to the surface the wireline is typically coated with well fluid within which is entrained contaminates from the well. Even though the wireline is passed through grease filled risers and grease wipers a certain amount of the well contaminates will be present on the wireline as it passes over the upper wireline sheave. While this is not a particular problem from the standpoint of open wireline sheaves when wireline sheaves are closed and adapted for containing well pressure the contaminates on the wireline can migrate to the sheave bearings so that the bearings can become fouled with the well contaminates. Under this condition the bearings will rather quickly deteriorate to the point that the sheave mechanism will need to be repaired or the sheave will require replacement. It is desirable therefore to provide a pressure containing sheave mechanism which effectively prevents migration of well contaminates from the wireline groove of the sheave to the sheave bearings. Virtually all wireline sheaves incorporate a sheave body structure having a sheave wheel rotatably located therein and having a large circular closure plate which is typically bolted to the sheave body and serves as a sealed retainer for the sheave wheel. The large circular seal for sealing the closure plate to the sheave body defines a very large closure plate area that is subject to pressure induced side loading. To withstand high pressure the closure plate must be of considerable thickness to withstand the influence of pressure on its substantially large pressure responsive area and a large number of large bolts of considerable length are typically required to secure the closure plate against the high pressure induced side load. It is desirable therefore to provide a sheave wheel assembly employing seals which minimize the pressure responsive area of the sheave chamber closure and thus minimize the side loading to which the sheave housing is subjected throughout the entire pressure range of the sheave mechanism.

SUMMARY OF THE INVENTION

It is a principal feature of this invention to provide a pressure containing wireline sheave mechanism which employs internal seals that establish a substantially pressure balanced condition to minimize pressure induced side loading of the sheave housing so that the sheave mechanism may be of relatively small dimension without any sacrifice from the standpoint of pressure containing capability.

It is also a feature of this invention to provide a pressure containing wireline sheave mechanism having pressure restraining seals which establish substantially the same pressure responsive differential area on opposite sides of a sheave containing chamber so that the rotatable sheave and the housing structure defining the sheave chamber are relatively free of any pressure induced side loading.

It is another feature of the present invention to provide a novel pressure containing sheave mechanism which is designed to restrict well pressure to an internal sheave chamber so that the body sections of the sheave mechanism are substantially subjected only to pressure induced hoop stresses which are safely restrained by the structural integrity of an outer sheave body.

It is another feature of this invention to provide a novel pressure containing sheave mechanism incorporating a bearing supported internal sheave and to provide a grease or lubricant injection capability that prevents migration of contaminates from the wireline groove of the sheave to the bearings thereof.

It is an even further feature of this invention to provide a novel pressure containing sheave mechanism having an internal rotatable sheave which is substantially pressure balanced and therefore is not subjected to excessive pressure induced forces during its operation.

It is also a feature of this invention to provide a novel pressure containing sheave mechanism which incorporates a split sheave design, enabling the sheave wheel to be assembled within an internal sheave recess which is defined within an integral internal sheave housing structure and which provides a substantially distortion free chamber for the sheave wheel even under extremely high pressure conditions.

It is an even further feature of this invention to provide a novel pressure containing sheave mechanism which is designed to permit grease injection directly into the sheave into the grease head attached to the sheave thus shortening the required length of the grease head that is ordinarily required.

It is an even further feature of this invention to provide a novel pressure containing sheave mechanism having a body structure defining a cable expansion groove in registry with the cable groove of the sheave wheel to thereby permit displacement of the cable from the sheave groove into the cable expansion groove to permit separation of the body sections while the wireline cable remains in assembly with the sheave body structure.

It is an even further feature of this invention to provide a high pressure containing wireline sheave mechanism wherein pressure induced side loading of sheave housing components is minimized by internal housing seals which have substantially the same diameter offset or differential area between the seals.

Briefly, the foregoing and other features of this invention are realized through the provision of a pressure containing sheave mechanism having an outer body structure defining an internal body opening within which is received a sheave housing which is secured to the body by means of a threaded connection or by any other suitable means. The sheave housing defines an internal circular sheave chamber within which is located a rotatable circular sheave which defines a wireline groove at its outer periphery for receiving a wireline that passes through the body structure. The sheave wheel is supported by bearings that are located within the internal sheave chamber which provide rotatable bearings port for the sheave wheel. The bearings are directly lubricated by grease which is continuously pumped into the internal sheave chamber at a location adjacent the bearings so that a positive flow of grease occurs within the sheave chamber in a direction toward the outer periphery of the sheave wheel to thus prevent contaminates from the sheave groove from migrating to and contaminating the bearings. Housing seals are provided which establish sealing between the sheave body and the sheave housing on each side of the internal sheave chamber to thereby substantially pressure balance the sheave chamber and thus prevent the sheave from being subject to pressure induced lateral side loads. The body seals have substantially the same diameter offset or differential area between them so that the sheave body structure is substantially free of pressure induced side loading. This pressure balanced condition also insures that the sheave body is subjected to pressure induced hoop stresses rather than pressure induced side loads so that the body can be of rather compact and light weight design without any sacrifice of standpoint of pressure containing capability.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention are therefore not to be considered limiting of its scope, for the invention may admit to other equally effective embodiments.

IN THE DRAWINGS

Figure 1:
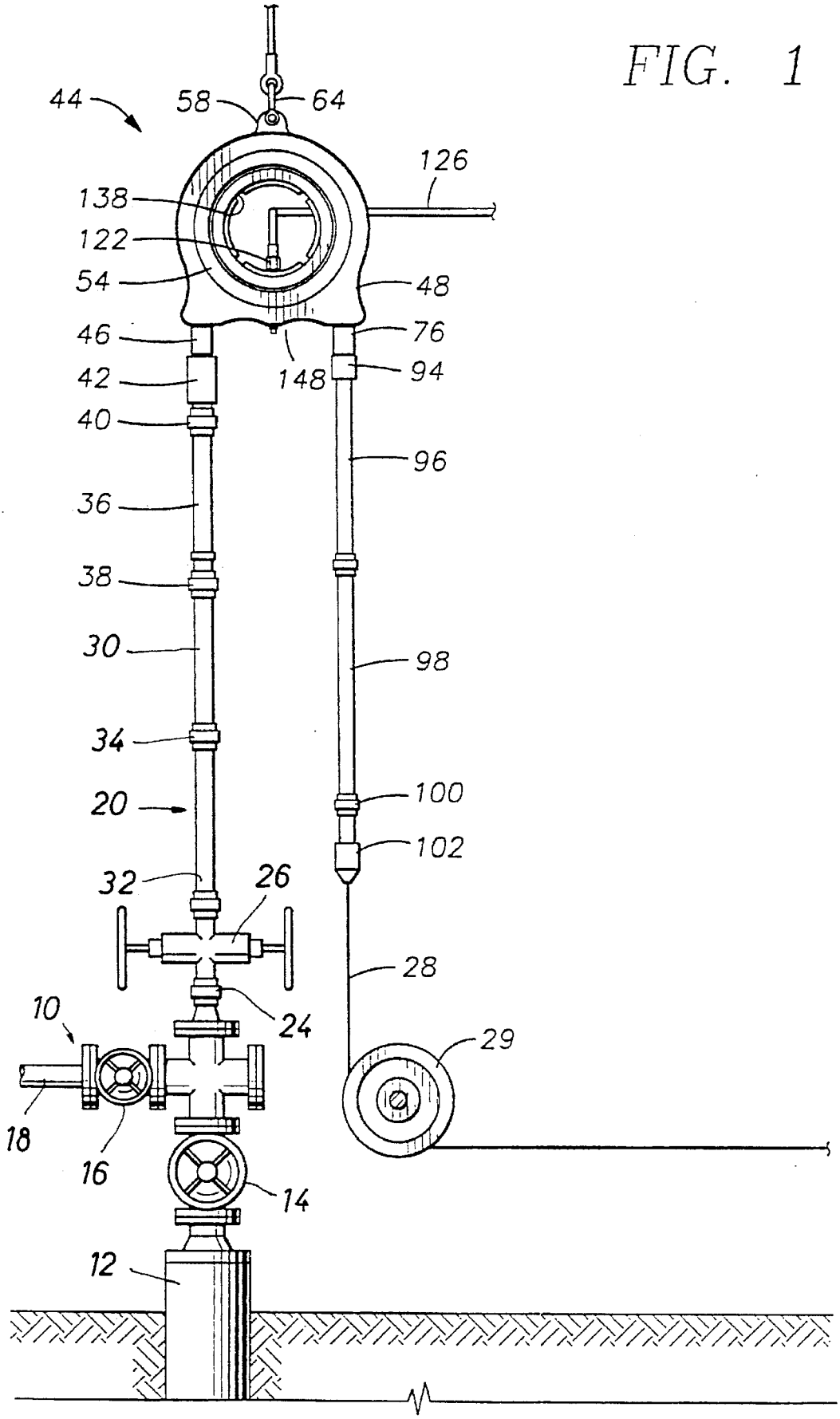

FIG. 1 is an elevational view of a wireline riser for well servicing activities which is shown connected to a well head and which is provided with the pressure containing sheave mechanism of this invention.

Figure 2:
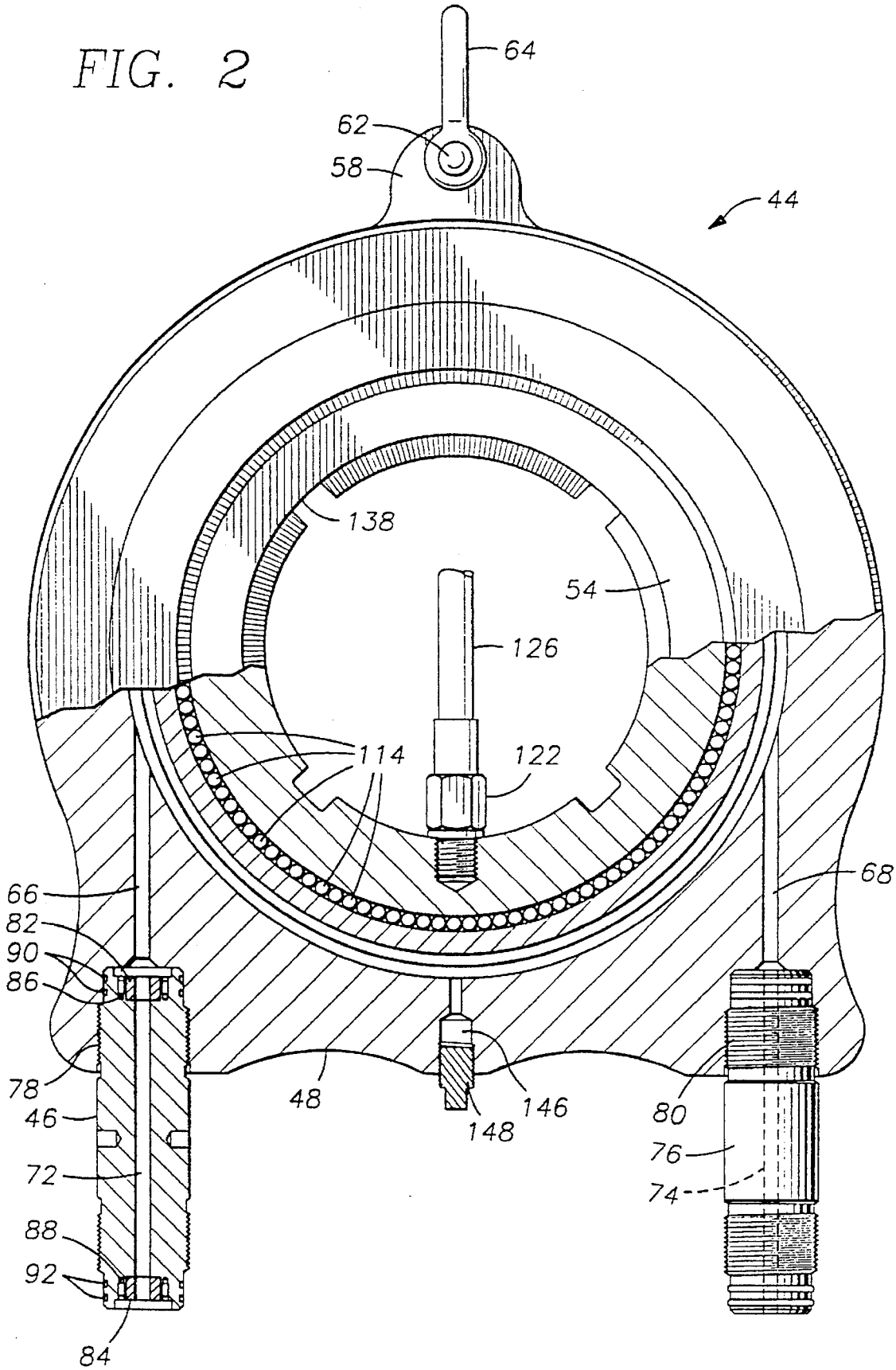

FIG. 2 is a side elevational view of the pressure containing sheave mechanism of this invention having portions thereof broken away and shown in section.

Figures 3, 5:
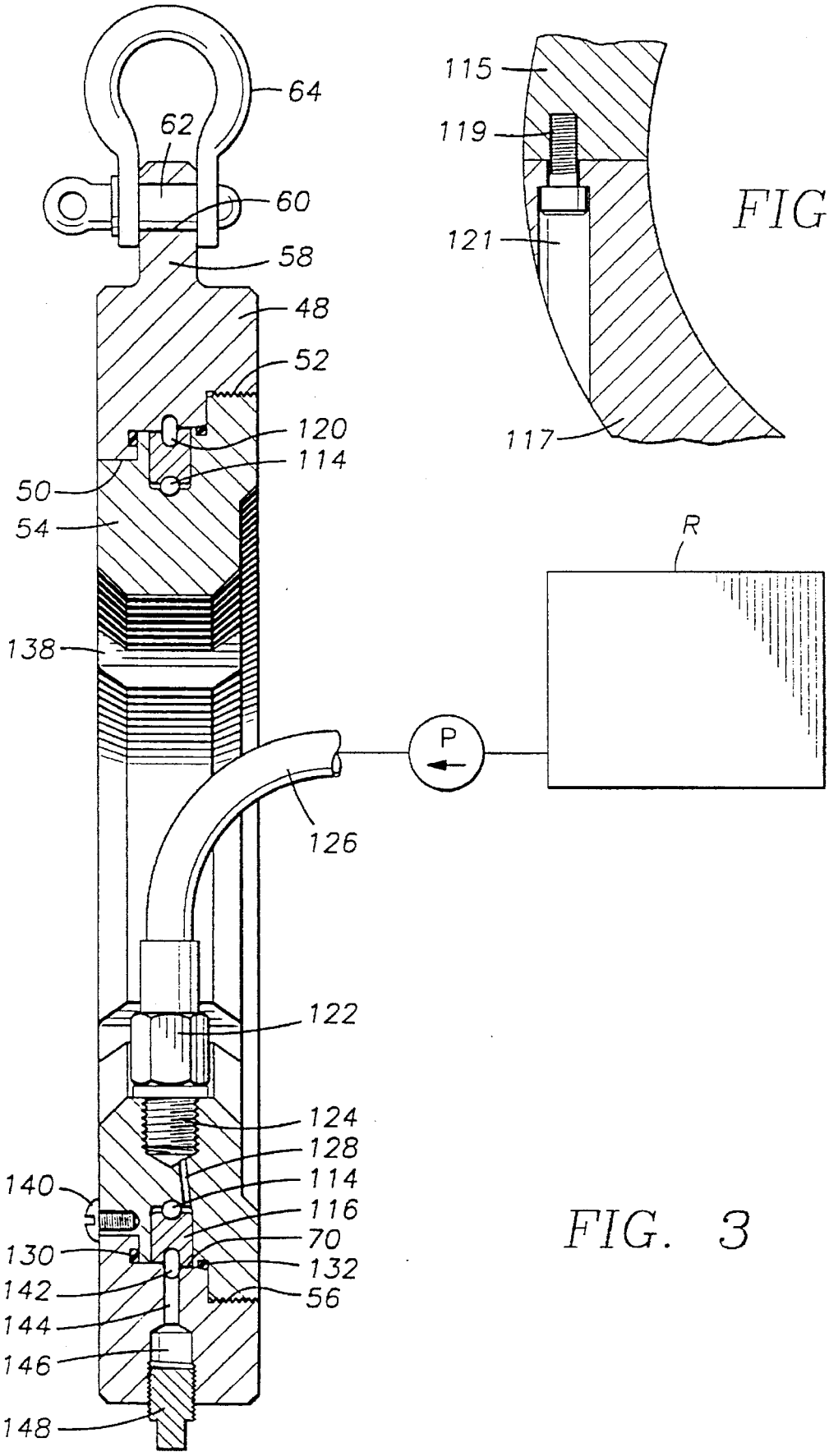

FIG. 3 is a sectional view taken along the line 3—3 of FIG. 2.

Figure 4:
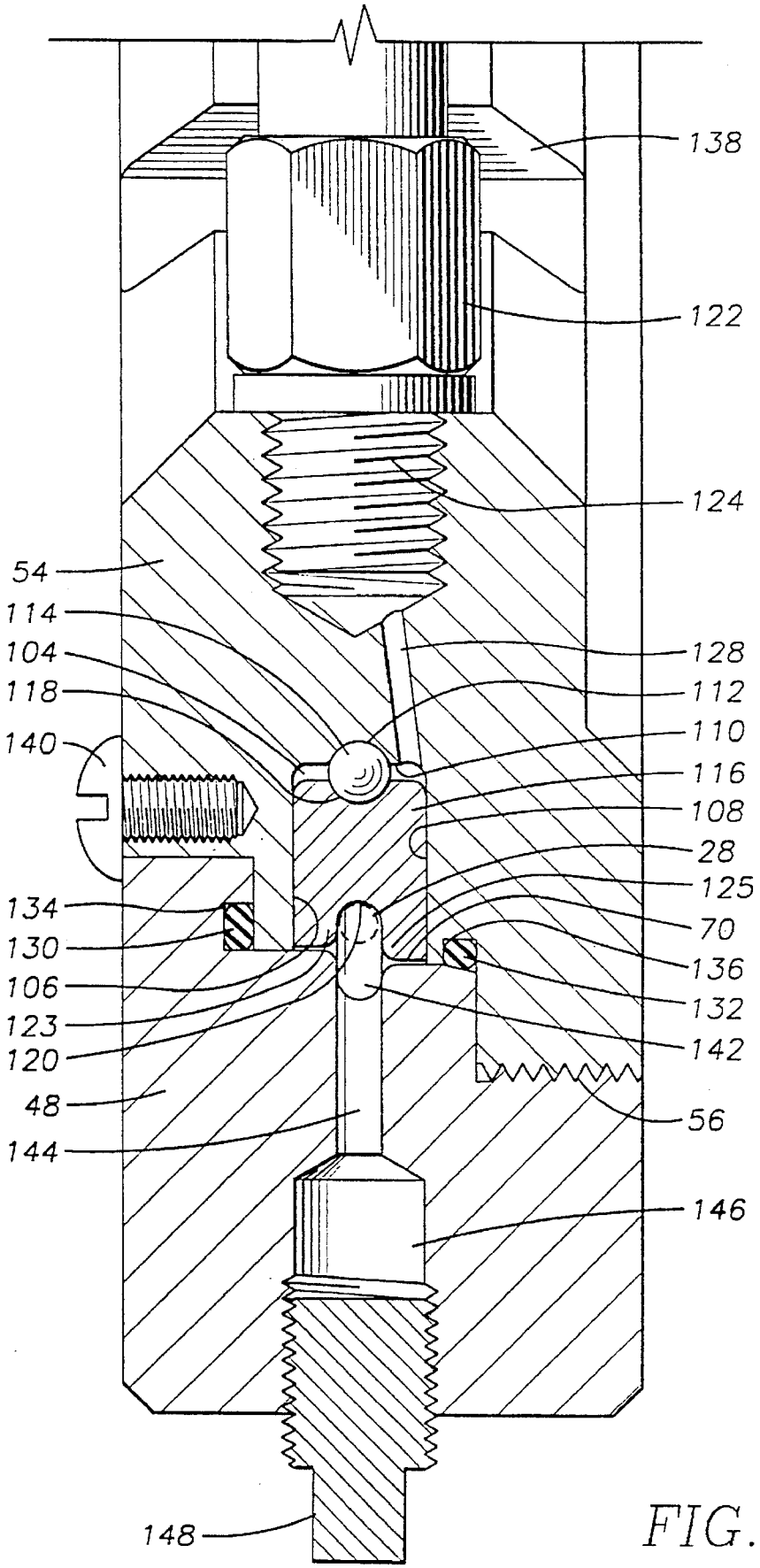

FIG. 4 is a fragmentary sectional view of the pressure containing sheave mechanism of FIG. 3 which is illustrated in greater detail as compared with FIG. 3.

FIG. 5 is a fragmentary sectional view of the sheave wheel showing it's sectional construction and pinned assembly.

DETAILED DESCRIPTION OF PREFERRED EMBODIMENTS

Referring now to the drawings and first to FIG. 1, a well head assembly shown generally at 10 is connected to the upper extremity of a well casing 12 and incorporates at least one safety valve 14 for the purpose of shutting in the well as desired. The well head is typically provided with at least one wing valve 16 that controls the flow of production fluid from the well head into a production line 18 extending to a suitable facility for receiving production fluid.

Under circumstances where wireline operations are to be conducted within the well a wireline riser assembly shown generally at 20 is connected to the upper portion of the well head assembly and is utilized to introduce a wireline tool string or assembly into the well such that it passes through the well head assembly and into the production tubing that extends downwardly to the production zone being produced by the well. Under circumstance where the well is being drilled there is of course no production tubing and a wireline operated tool such as a logging tool, perforating gun, etc. is lowered into the well casing or well bore as the case may be by means of a wireline running tool. A typical wireline tool assembly such as that shown at 20 will be connected to the well head by means of a union 24 and will include a wireline blowout preventer 26 having two or more wireline rams that are capable of closing and achieving a seal about the wireline 28 that extends through the wireline tool assembly. Typically a wireline riser assembly will incorporate upper and lower lubricators 30 and 32 that are interconnected by a lubricator union 34. The wireline riser may also incorporate a wireline cutter and safety mechanism shown at 36 which is coupled to the upper lubricator by a connector union 38. A coupling 40 is utilized at the upper end of the wireline cutter 36 to provide for connection of a head catcher 42 which automatically receives and restrains the upper portion of the wireline tool head as it is moved to its full extent within the tool riser above the blowout preventer.

According to the principles of the present invention the wireline riser is provided with a pressure containing sheave mechanism which is internally pressure balanced to minimize side loading of the sheave body and housing assembly. A pressure coming wireline sheave mechanism, shown generally at 44 and representing the preferred embodiment of the invention, is provided at the upper end of the tool riser and is connected to the head catcher 42 by means of a flow tube connector 46 which is shown in greater detail in FIG. 2. As shown in FIGS. 2 and 3 the pressure containing wireline sheave mechanism incorporates a sheave body 48 which defines a circular internal opening 50 with a portion thereof being internally threaded as shown at 52. A circular sheave housing 54 is designed with an external configuration corresponding to the internal configuration of the body opening 50 is retained in immovable assembly with the body by means of an externally threaded section 56 which establishes a threaded connection with internal threaded section 52 of the body.

The upper portion of the body 48 is provided with a connector projection 58 having a transverse bore 60 through which extends the connector pin 62 of a support shackle 64. The connector pin 62 is threaded into the support shackle 64 so that it will not become inadvertently separated from the support shackle or from the transverse bore 60. Any suitable support mechanism may be employed for supporting engagement with the support shackle so as to support the pressure containing sheave mechanism in operative relation with the wireline riser apparatus.

To provide for traversal of the wireline through the body structure 48 the body defines substantially parallel wireline passages 66 and 68 which are oriented in substantially tangential relation with a circular inner surface 70 which defines a portion of the body opening 50. The wireline extending through the passages 66 and 68 also extends through central passages 72 and 74 of flow tube 46 and a grease tube connector 76 which are each disposed in threaded connection with the body via threaded connectors 78 and 80 respectively. To insure against loss of lubricant from the pressure containing sheave mechanism the flow tube connector 46 is provided with upper and lower carbide inserts 82 and 84 which are secured within respective internally threaded extremities of the flow tube connector by means of retainer screws 86 and 88. Seals 90 and 92 are retained within seal grooves at each end of the flow tube connector to establish a high pressure containing seal with the body structure 48 and with the tool riser assembly of the wireline mechanism. A coupling 94, shown in FIG. 1, is received in sealed assembly with the grease seal connector 76 and provides for coupling of grease seal conduits 96 and 98 which contain grease for maintaining a seal with the wireline 28. The lowermost grease seal conduit 98 is provided with a coupling 100 to which is connected a cable wiper assembly 102 for minimizing grease loss as the wireline cable passes through it. As indicated above, the wireline cable passes about a lower orienting sheave 29 and then extends to a conventional winch, not shown, by which it is paid out or taken up during wireline servicing operations.

As shown in FIG. 3 and in greater detail in FIG. 4 the sheave housing 54 defines an internal sheave recess or chamber 104 which is defined generally parallel radial surfaces 106 and 108 and by an internal generally cylindrical surface 110. The internal sheave recess or chamber 104 opens radially outwardly toward the opposed internal surface 70 of the body 48. The internal cylindrical surface 110 is centrally grooved as shown at 112 to define a circular bearing track which receives a plurality of spherical bearings 114. Within the internal sheave recess 104 is rotatably located a circular sheave wheel element 116 having an inner periphery which defines a circular bearing track or race 118 within which the bearings 114 are received to provide bearing support for the inner periphery of the circular sheave wheel 116. The outer periphery of the sheave wheel defines a circular wireline groove 120 which is disposed in registry with the wireline passages 66 and 68 of the body 48 so that the wireline 28 is received within the wireline groove 120 as the moving wireline induces rotation to the sheave wheel. As shown in FIG. 5 the sheave wheel 116 is of segmented construction enabling its segments 115 and 117 to be installed within the sheave chamber and interconnected by dowel pins 119 which are received within drilled assembly holes 121.

The sheave wheel defines an inner circular flange 123 and an outer circular flange 125 which are located on opposite sides of the circular cable groove 120. As is evident from FIG. 4 the inner flange 123 is of less diameter as compared with the outer flange 125. These differently dimensioned flanges 123 and 125 correspond with the offset of the cylindrical internal surfaces 70 and 71 which are defined within the sheave body 48 on respective inner and outer sides of the cable expansion groove 142. As the sheave housing 54 is separated from the sheave body 48 any wireline cable strands that might extend toward the expansion groove will not become fouled between the sheave wheel and body. The less dimensioned inner flange 123 defines a clearance with the cylindrical internal surface 70 to permit the wireline cable to move laterally along with the sheave housing and sheave during disassembly from body 48 without becoming fouled or damaged.

When the tool riser assembly 20 of the wireline service apparatus is pressurized by well pressure, this pressure is communicated into the internal sheave recess or cavity 104 via passages 72 of the flow tube connector 46 and passage 66 of the sheave body 48. To enhance the pressure containing and sealing capability of the sheave assembly it is desirable to inject grease or lubricant into the sheave cavity 104 both for its sealing capability and for lubricating the spherical bearings 114. It is also desirable to prevent migration of well fluid contaminates from the external wireline groove 120 of the sheave to the spherical bearings 114 to thereby insure against contaminate induced accelerated bearing wear. These features are effectively accomplished by providing a grease fitting 122 having an externally threaded connector 124 which is received within an internally threaded opening located at the inner periphery of the sheave housing 54. The grease fitting is connected via a high pressure conduit 126 to a grease pump P, as shown in FIG. 3, which has its suction in communication with a grease reservoir R and its discharge in communication with the high pressure conduit 126. Typically the conduit 126 will be a flexible hose capable of withstanding high well pressure for example in the range of 10,000 psi. The grease supply conduit 126 may also take any other suitable form without departing from the spirit and scope of this invention.

To prevent migration of contaminates toward sheave bearings it is desirable to provide a flow of grease within the sheave chamber 110 which is in a direction toward the wireline groove 120 of the sheave wheel. For this reason the pump P has a discharge pressure which exceeds well pressure so that during operation of the pressure containing sheave mechanism a unidirectional flow of grease will occur from the grease fitting 122 through a grease supply passage 128 into the sheave chamber 110 at a location immediately adjacent the bearing races of the sheave housing and sheave wheel within which the sheave bearings 114 are located. As the wireline is run through the sheave mechanism a small quantity of grease will continuously be lost by virtue of its adherence to the wireline. This grease loss will be continuously replenished by the flow of grease being injected through the grease supply passage 128 to the sheave chamber 110. Thus, during the operation of the sheave mechanism a positive unidirectional flow of grease will occur in a direction toward the wireline groove of the sheave wheel. The sheave bearings will therefore remain free of contaminates and will be appropriately lubricated by the grease. The service life of the sheave mechanism, being protected by continuously replenished lubrication, will therefore be quite long.

As mentioned above it is a feature of this invention to provide a pressure containing sheave mechanism which is capable of withstanding high well pressure such as 10,000 psi for example without necessitating the provision of a heavy and bulky sheave construction. This feature is attained by providing the sheave and sheave chamber with a substantially pressure balanced condition to minimize pressure induced side loading forces and to insure that the body structure of the sheave mechanism is subjected, for the most part, only to pressure induced hoop stresses which are readily restrained by the sheave body. Sealing between the sheave body 48 and the sheave housing 54 is achieved by a pair of circular sealing elements 130 and 132 which are appropriately contained within circular seal grooves 134 and 136 respectively. Sealing elements 130 and 132 confine well pressure acting within the housing 48 to the internal surface area 70 that is located between the seals. The seals 130 and 132 establish approximately the same diameter offset or differential area between the seals. Thus the rotatable sheave is substantially pressure balanced and is not subject to significant pressure induced side loading. Surface 70 therefore is subjected to pressure induced force acting radially thereon, thereby causing the body structure 48 to be subjected to radially outward pressure induced force or hoop stress which is easily restrained by the body structure. The hoop surface area defined by the surface 70 is rather small in comparison to the structural configuration of the body so that the hoop stress is confined to the central portion of the body structure and is easily contained by the hoop integrity of the body 48.

To facilitate assembly and disassembly of the sheave housing 54 from the body 48 the inner periphery of the sheave housing 54 defines a plurality of tool recesses 138, as shown in FIG. 3, which receive a spanner tool or other suitable tool for achieving rotation of the sheave housing relative to the body so as to makeup or unthread the threaded connection 56. To provide a positive stop to prevent inadvertent unthreading of the housing from the body one or more retainer screw 140 are secured to the housing in such manner that the heads thereof overlie the circular joint between the body and housing as shown in FIG. 3. It will frequently be desirable to separate the sheave housing 54 from the body 48 while the wireline remains threaded through the passages 66 and 68 of the body. To provide for this feature the body 48 defines a circular cable expansion groove 142 which is disposed in registry with the external cable recess of the sheave 116. The wireline cable may then be shifted radially outwardly into the cable expansion groove 142 to provide clearance for lateral movement of the outer peripheral portions of the sheave housing and sheave while the wireline cable remains threaded through the passages 66 and 68 of the body.

It may be desirable to provide for introduction of supplementary grease into the sheave cavity for enhancing the sealing capability of the sheave mechanism or positively sealing the wireline for more adequate containment of well pressure. This feature is realized by providing a grease injection passage 144 in the sheave body 48 which is in communication with the cable expansion groove 142. The passage 144 is adapted to receive sealant grease from an internally threaded passage 146 which is normally dosed by a threaded closure plug 148. In absence of well pressure within the sheave cavity the closure plug 148 may be removed and a grease injection conduit may be threadedly connected to the body in its place. Typically this grease injection conduit will be the supply hose of a hand pump type grease gun which may be employed to manually inject grease into the sheave cavity for enhancing the pressure containment capability of the sheave mechanism. In the alternative the closure plug 148 may be replaced by a conventional grease fitting to which a grease supply hose fitting is connected. Grease can then be injected from a grease gun into the sheave wheel chamber even under high pressure conditions.

From the foregoing it is apparent that a novel pressure balanced, high pressure wireline sheave apparatus has been provided which minimizes pressure induced side loading forces within the sheave mechanism of this invention to thus ensure proper operation and extensive service life of the sheave even under extremely high pressure conditions. It is therefore apparent that this invention is one well adapted to achieve all of the objects and features that have been set forth above. While the invention has been explained in terms of particularly advantageous embodiments, it will be understood by those skilled in the art that various changes may be made in the structures described herein without departing from the scope of the invention which is defined by the following claims.

What is claimed is:

1. A substantially pressure balanced, pressure containing sheave mechanism, comprising:

(a) sheave body means having circular internal pressure exposed surface means and defining an internal opening and defining first and second wireline passages intersecting said internal opening;

(b) sheave housing means having circular external pressure exposed surface means and being located within said internal opening and establishing a circular connection joint with said sheave body means at said internal opening with said internal and external pressure exposed surface means being disposed in substantially radially adjacent relation;

(c) one of said sheave body means and sheave housing means defining a circular sheave chamber;

(d) a circular sheave element being located for rotation within said circular sheave chamber and defining an outer peripheral wireline groove in registry with said first and second wireline passages;

(e) bearing means establishing rotatable bearing support for said circular sheave element within said circular sheave chamber; and (f) means establishing sealing between said sheave body means and said sheave housing means at said internal and external pressure exposed surface means and substantially confining internal pressure of said sheave mechanism to said internal and external pressure exposed surface means at said circular connection joint to substantially confine pressure within said circular sheave chamber to said internal and external pressure exposed surface means and minimize pressure induced side loading of said sheave housing and sheave body.

2. The substantially pressure balanced, pressure containing wireline sheave mechanism of claim 1, wherein:

said means establishing sealing being a pair of circular sealing elements each establishing seals between said sheave body means and said sheave housing means and being located in spaced relation with said sheave chamber located therebetween, said circular sealing elements being exposed to pressure from said sheave chamber and establishing seals of substantially the same dimension with said sheave body means and said sheave housing means to substantially confine internal pressure to said circular internal and external pressure exposed surface means.

3. The substantially pressure balanced, pressure containing wireline sheave mechanism of claim 2, wherein:

(a) said circular internal and external pressure exposed surface means being oriented such that pressure acting thereon induces hoop stress to said sheave body means; and (b) said pair of circular sealing elements substantially confining pressure to said circular internal and external pressure exposed surface means and minimizing pressure induced side loading of said sheave housing means and sheave body means relative to one another.

4. The substantially pressure balanced, pressure containing wireline sheave mechanism of claim 1, wherein said circular sheave chamber comprises:

(a) a pair of spaced, generally planar radial surfaces being defined by said sheave housing and being disposed in substantially parallel relation and defining opposed side surfaces of said sheave chamber; and (b) a generally cylindrical surface being defined by said sheave housing and being oriented in transverse relation to said generally planar radial surfaces and defining a bottom surface of said circular sheave chamber.

5. The pressure containing wireline sheave mechanism of claim 1, wherein said circular sheave element comprises:

(a) first and second sheave sections; and (b) means for securing said first and second sheave sections in assembly to define an integral sheave assembly.

6. The pressure containing wireline sheave mechanism of claim 1, wherein:

said sheave body means defines an internal wireline expansion groove disposed in radial registry with said external cable groove of said sheave element for receiving said wireline and permitting separation of said sheave housing means from said sheave body means while said wireline cable remains within said sheave body means.

7. The pressure containing wireline sheave mechanism of claim 1, further comprising:

(a) said sheave housing means defining a lubricant passage extending opening into said circular sheave chamber;

(b) a source of pressurized lubricant: and (c) means conducting lubricant from said source of pressurized lubricant to said lubricant passage and into said circular sheave chamber.

8. The pressure containing wireline sheave mechanism of claim 1, further comprising:

means securing said sheave body means and said sheave housing means in releasable assembly.

9. The pressure containing wireline sheave mechanism of claim 8, wherein said securing means comprises a threaded connection.

10. A substantially pressure balanced, pressure containing sheave mechanism, comprising:

(a) sheave body means having a circular internal pressure exposed surface defining an internal opening and further defining first and second wireline passages intersecting said internal opening;

(b) sheave housing means being located within said internal opening and defining a circular sheave chamber located radially inwardly of said circular internal pressure exposed surface means and opening toward said circular internal pressure exposed surface means, said sheave housing means further defining circular external pressure exposed surface means in radial juxtaposition with said circular internal pressure exposed surface means;

(c) a circular sheave element defining inner and outer peripheries and being located for rotation within said circular sheave chamber and defining an external cable groove for receiving a wireline;

(d) bearing means being located within said circular sheave chamber and establishing bearing support for said inner periphery of said circular sheave element;

(e) means establishing sealing between said sheave body means and said sheave housing means at said internal and external pressure exposed surface means and substantially confining pressure within said circular chamber to said circular internal pressure exposed surface of said sheave body means and minimizing pressure induced side loading of said pressure containing sheave mechanism; and (f) lubricant injection means of injecting lubricant into said circular sheave chamber at a location adjacent said bearing means for lubrication of said bearing means and for preventing well pressure induced migration of contaminants from said external cable groove to said bearing means.

11. The pressure containing wireline sheave mechanism of claim 10, wherein said circular sheave element comprises:

(a) first and second sheave sections; and (b) means for securing said first and second sheave sections in assembly to define an integral sheave assembly.

12. The pressure containing wireline sheave mechanism of claim 10, wherein:

said sheave body means defines an internal wireline expansion groove disposed in radial registry with said external cable groove for receiving said wireline and permitting separation of said sheave housing means from said sheave body means while said wireline cable remain within said sheave body means.

13. The pressure containing wireline sheave mechanism of claim 10, wherein said lubricant injection means comprises:

(a) a lubricant passage extending from the inner periphery of said sheave housing means and opening into the outer periphery of said circular sheave chamber at a location adjacent said bearing means; and (b) a lubricant fitting being located at the inner periphery of said sheave housing means for receiving lubricant from a pressurized source thereof and conducting said lubricant to said lubricant passage.

14. The substantially pressure balanced, pressure containing wireline sheave mechanism of claim 10, wherein:

said means establishing sealing being a pair of circular sealing elements establishing sealing between said sheave body means and said sheave housing means at said internal and external pressure exposed surface means and being located on opposed sides of said circular sheave chamber, said circular sealing elements being exposed to the pressure of said circular sheave chamber and being of substantially the same dimension for substantially pressure balancing said sheave mechanism to minimize pressure induced side loading thereof.

15. The pressure containing wireline sheave mechanism of claim 10, further comprising:

means securing said sheave body means and said sheave housing means in releasable assembly.

16. The pressure containing wireline sheave mechanism of claim 15, wherein said securing means comprises a threaded connection.

17. A substantially pressure balanced, pressure sheave mechanism, comprising:

(a) sheave body means defining an internal opening and defining first and second wireline passages intersecting said internal opening, said sheave body means having internal pressure exposed surface means;

(b) sheave housing means being located within said internal opening and defining external pressure exposed surface means being positioned in radially juxtaposed relation with said external pressure exposed surface means;

(c) said sheave body means and sheave housing means cooperatively defining a circular sheave chamber having a circular joint defined in part by said internal and external pressure exposed surface means;

(d) a circular sheave element being located for rotation within said circular sheave chamber and defining an outer peripheral groove for receiving a wireline extending through said first and second wireline passages;

(e) bearing means being located within said circular sheave chamber and establishing bearing support for the inner periphery of said circular sheave element; and (f) a pair of spaced circular sealing elements establishing sealing between said sheave body means and said sheave housing means at said internal and external pressure exposed surfaces and restricting induced force of said pressure within said circular sheave chamber to a finite portion of said internal pressure exposed surface so that said pressure induced force acts principally radially outwardly on said sheave body means and subjects said sheave body means to hoop stress while said sheave mechanism is maintained substantially free of pressure induced side loads.

18. The substantially pressure balanced, pressure containing wireline sheave mechanism of claim 17, wherein:

(a) said spaced circular sealing elements establishing sealing engagement with said sheave body means and sheave housing means on opposite sides of said circular sheave chamber; and (b) said spaced circular sealing elements confining pressure exposure to a finite portion of said internal pressure exposed surface means.

19. The pressure containing wireline sheave mechanism of claim 17, wherein:

said sheave body means defines an internal circular wireline displacement groove disposed in radial registry with said outer peripheral wireline groove of said sheave element for receiving said wireline to permit separation of said sheave housing means from said sheave body means while said wireline remains extended through said sheave body means.

20. The pressure containing wireline sheave mechanism of claim 17, further comprising:

lubricant injection means for substantially continuously injecting lubricant into said circular sheave chamber at a pressure exceeding sheave chamber pressure and at a location adjacent said bearing means for lubrication of said bearing means and for preventing pressure induced migration of contaminants from said external wireline groove of said sheave element to said bearing means.

21. The pressure containing wireline sheave mechanism of claim 20, further comprising:

(a) a flow tube being connected to said sheave housing means and defining a wireline passage in registry with one of said first and second wireline passages, said wireline passage receiving said wireline; and (b) restriction means being provided within said flow tube about said wireline passage and restricting escape of grease from said sheave housing along said wireline during operation of said pressure containing sheave mechanism.

22. A pressure containing sheave mechanism for use with a wireline extending into a well containing high pressure fluid, the mechanism comprising:

a first sheave housing member having a circular internal opening and first and second wireline passages intersecting said opening;

a second sheave housing member secured to the first sheave housing member, at least part of the second sheave housing member fitting within the opening in the first sheave housing member, and an annular sheave chamber being sealingly disposed between said sheave housing members; and an annular sheave element mounted coaxially within said sheave chamber and having a radially outwardly facing peripheral groove in registry with said first and second wireline passages, said sheave element being rotatably supported on a bearing disposed radially inwardly thereof within said chamber, said second sheave housing member defining a pressurized lubricant passage communicating with said bearing, and means for supplying lubricant at a pressure no less than the pressure of the well fluid in said wireline passages and said groove to the bearing to oppose the entry of well fluid into the bearing.

23. A sheave mechanism in accordance with claim 22, wherein the opening in the first sheave housing member has a radially inwardly facing cylindrical surface, said part of the second sheave housing member having a radially outwardly facing cylindrical surface facing and closely adjacent the cylindrical surface of the opening, and said sheave chamber is defined by a groove formed in one of said surfaces and the portion of the other surface facing the groove.

24. A sheave mechanism in accordance with claim 22 wherein said means for supplying lubricant comprises a high pressure pump for supplying said lubricant to said bearing.

25. A sheave mechanism in accordance with claim 24, wherein said first and second sheave housing members are secured together by a threaded interconnection.

26. A sheave mechanism in accordance with claim 22, further comprising a flow tube connected to said first sheave housing member and defining a further wireline passage in registry with one of said first and second wireline passages, said further wireline passage receiving said wireline, and restriction means provided within said flow tube about said further wireline passage and restricting escape of lubricant from said first sheave housing member along said wireline during operation of said sheave mechanism.

27. A pressure containing sheave mechanism for use with a wireline extending into a well containing high pressure fluid, the mechanism comprising:

a first sheave housing member having a circular internal opening and first and second wireline passages intersecting said opening;

a second sheave housing member secured to the first sheave housing member, at least part of the second sheave housing member fitting within the opening in the first sheave housing member, and an annular sheave chamber being sealingly disposed between said sheave housing members; and an annular sheave element mounted coaxially and rotatably within said sheave chamber and having a radially outwardly facing peripheral groove in registry with said first and second wireline passages, the opening in the first sheave housing member having a radially inwardly facing cylindrical surface, said part of the second sheave housing member having a radially outwardly facing cylindrical surface facing and closely adjacent the cylindrical surface of the opening, and said sheave chamber is defined by a groove formed in one of said surfaces and the portion of the other surface facing the groove.

28. A sheave mechanism in accordance with claim 27, wherein a respective circular sealing means is provided between the sheave housing members, in the opening, on each side of the chamber-defining groove.

29. A sheave mechanism in accordance with claim 28, wherein said chamber-defining groove is formed in the second sheave housing member.

30. A sheave mechanism in accordance with claim 29, wherein the cylindrical surface of the first sheave housing member includes a wireline expansion groove extending therearound in registry with the peripheral groove in the sheave element to receive the wireline and thereby facilitate separation of the sheave housing members.

31. A sheave mechanism in accordance with claim 30, wherein the annular sheave element is formed in two separable sections which are secured together.

32. A sheave mechanism in accordance with claim 30, wherein said sheave element is rotatably supported on a bearing disposed radially inwardly thereof within said chamber, and said second sheave housing member includes a pressurized lubricant passage for supplying lubricant to said bearing.

33. A sheave mechanism in accordance with claim 32, wherein said bearing is a ball bearing.

34. A sheave mechanism in accordance with claim 24, further comprising a flow tube connected to said first sheave housing member and defining a further wireline passage in registry with one of said first and second wireline passages, said further wireline passage receiving said wireline, and restriction means provided within said flow tube about said further wireline passage and restricting escape of lubricant from said first sheave housing member along said wireline during operation of said sheave mechanism.

* * * * *